United States Patent [19]

Pomerleau

[11] Patent Number: 5,007,669

[45] Date of Patent: Apr. 16, 1991

[54] LEVERAGED SECURITY DOOR LOCK

[76] Inventor: Kevin L. Pomerleau, 8621 Montezuma, #311, San Diego, Calif. 92115

[21] Appl. No.: 520,744

[22] Filed: May 9, 1990

[51] Int. Cl.[5] ..... E05C 17/12

[52] U.S. Cl. ..... 292/262; 292/244; 292/263; 292/207

[58] Field of Search ..... 292/263, 259, 244, DIG. 32, 292/DIG. 72, 266–270, 273, 274, 207, DIG. 57

[56] References Cited

U.S. PATENT DOCUMENTS

| | | | |
|---|---|---|---|
| 876,831 | 1/1908 | Olson | 292/DIG. 72 X |
| 941,493 | 11/1909 | Butler | 292/266 |
| 2,091,015 | 8/1937 | Sargent | 292/274 |
| 3,761,135 | 9/1973 | Mundinger et al. | 292/259 X |
| 4,067,598 | 1/1978 | Monsour | 292/259 R |

*Primary Examiner*—Richard E. Moore

*Attorney, Agent, or Firm*—Ralph S. Branscomb

[57] ABSTRACT

A leveraged door lock combines the limiting function of a door chain with a leveraged bar so that the resident has a substantial mechanical advantage enabling him or her to force the door closed against one who attempts to gain forcible entry once the door is cracked open. The entire mechanism swings between a horizontally extended operative mode, down into a vertical depending mode alongside the door, which frees the door for normal use.

10 Claims, 1 Drawing Sheet

FIG. 1
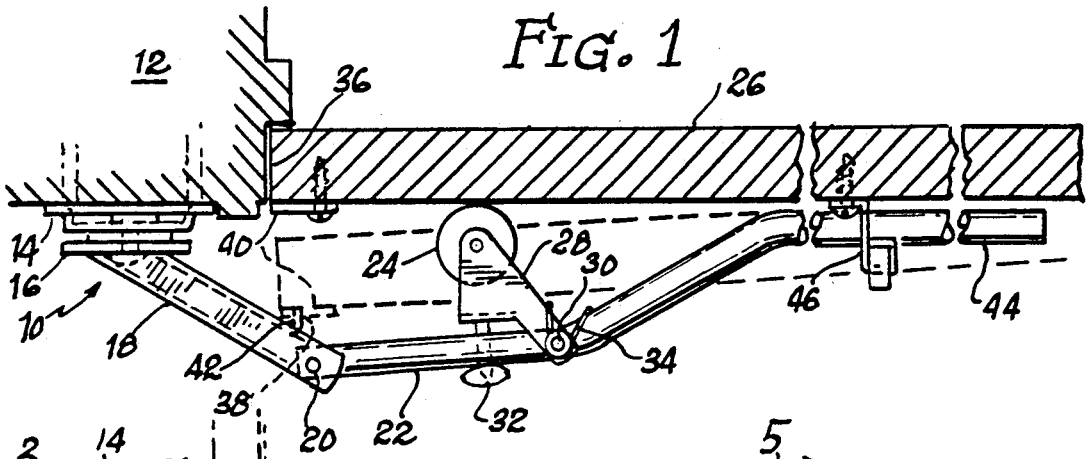
FIG. 2
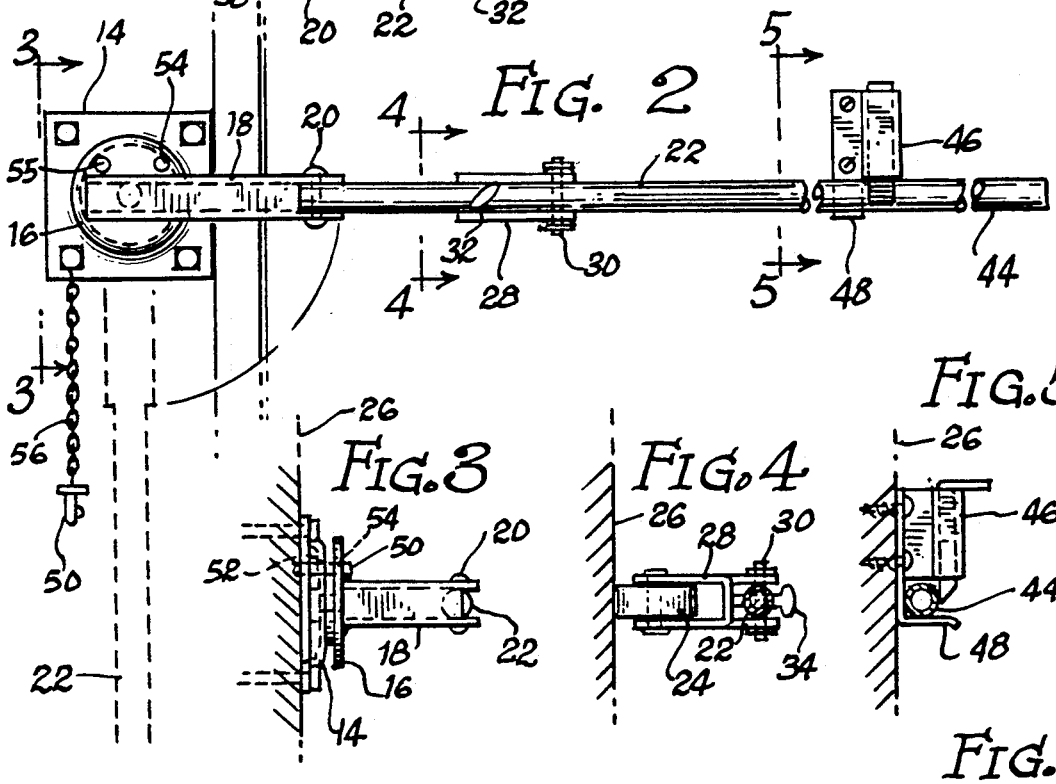
FIG. 3
FIG. 4
FIG. 5
FIG. 6
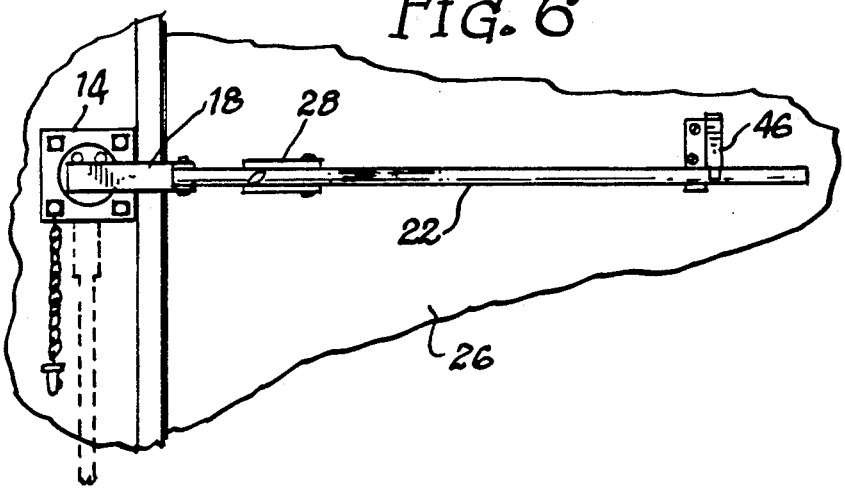
FIG. 7
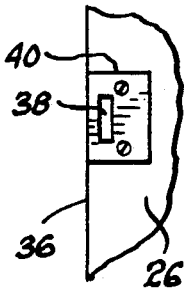

LEVERAGED SECURITY DOOR LOCK

BACKGROUND OF THE INVENTION

The invention is in the field of security devices, and particularly pertains to security for hinged exterior doors such as the front door. There are, both on the market and in the Patent Office, a number of different devices which limit the amount that a door can be opened before the limiting device is released. The most common, and probably the oldest of these is the door chain. Once the door is opened to the extent permitted by the chain, it can be opened no further until the door is reclosed.

There are several variations of the door chain on the market, often involving hinged bars or plates which interact with structure on the other side of the door opening to achieve the same result as the chain. Some of these devices are improvements, and others are perhaps no more effective but have an advantage only in their novel or cosmetic appearance.

It is a common characteristic of all of these limiters that the door cannot be opened until it is at least partially re-shut to enable the resident to disengage the limiting device. However, a common shortcoming in these limiters is that there is no way of forcing the door closed once it is open. A stronger person on the outside of the door could insert a weapon through the opening, or force the door completely open by breaking the limiting device when forcing it against a weaker person inside, such as an elderly person. The only obstacle between the intruder and the resident is the strength of the limiting device and the limited gap between the door and the door frame.

There is need, in addition to a gap-limiting device, a means of forcibly closing the door which is effective even if the resident is of substantially inferior strength compared to the intruder.

SUMMARY OF THE INVENTION

The instant invention fulfills the above need by providing a leveraged lock structure which provides both a limiting function to allow the door to be opened only an inch or two to permit communication between persons on opposite sides of the door, and also a leveraged bar with a roller which enables the person inside the building to quite forcibly close the door even against an intruder of greatly superior strength.

The invention comprises a bar which is swivel-mounted to a bar mount attached to the door frame alongside the opening edge of the door. This mount will swing from a position in which the bar depends vertically alongside the door to a position in which the bar can be swung horizontally against the door, with the leveraged end of the bar engaged in a latch on the door to hold the door securely shut.

The bar mount, which is mounted to the door frame, also defines the limiting mechanism in the form of a projection which will engage in an opening defined in the door as the door is opened. This occurs automatically when the door is opened, and at this point, if the resident wishes to force the door closed against an intruder by pressing the now-horizontally extended bar toward the door, a roller mounted on the bar rolls against the door and presses it shut, while the distal end of the bar is engaged in a latch mounted on the door.

BRIEF DESCRIPTION OF THE DRAWINGS

FIG. 1 is a top plan view of the invention;

FIG. 2 is a front elevation view of the invention;

FIG. 3 is a section taken along line 3—3 of FIG. 2;

FIG. 4 is a section taken along line 4—4 of FIG. 2;

FIG. 5 is a section taken along line 5—5 of FIG. 2;

FIG. 6 is a front elevation view of the bar;

FIG. 7 is a front elevation view of a detail on the door showing the opening which cooperates with the projection on the bar mount to act as an opening limiter.

DETAILED DESCRIPTION OF THE PREFERRED EMBODIMENT

The assembly is anchored by a bar mount 10 which mounts to the door frame 12. The term "door frame" is used here to include any stable surface alongside the door, and is not limited to the immediate wood framing that defines the door opening.

In the preferred embodiment the bar mount 10 is pivotal about a central axis perpendicular to the door frame surface so that the bar structure can swing between the horizontally extended mode illustrated in FIG. 2 to the depending, vertical passive mode indicated in dashed lines in the same figure. A strong, easily swiveled mount can be provided from a heavy duty swivel caster mount having internal ball bearings, which in fact was the type of mount used in the prototype. This type of mount has a mounting plate 14, a circular ball bearing race and the external portion 16 which actually rotates.

The rotating portion 16 has an extending arm 18, the extended end of which defines a pivot 20 which pivotally mounts the leverage bar 22. This arm is very strong and is square in cross section as best seen in FIG. 2.

The leverage bar 22 obviously must be made of a strong material, with steel or another metal being the most obvious choice. Its precise configuration is obviously subject to some variation as well. The bar may be substantially straight, or it may define appropriate bends as in the illustrated embodiment as shown in FIG. 1. In any event it requires some kind of a bearing, such as the roller 24, which presses against the door 26. The roller is mounted on a swing arm 28 which pivots on the bar at 30, and the swing arm structure adjusts the position of the roller by means of the stop bolt 32 which is threaded through the bar and provides a backstop for the swing arm. A spring 34 biases the swing arm against the stop so it does not flop around in use.

It can be seen by studying FIG. 1 that when the bar is swung outwardly toward the user, on the pivot 20, the door will open until the free edge 36 moves to the position shown in phantom in FIG. 1. In this position, an aperture 38 defined in an aperture plate 40 which is mounted on the door engages a projection 42 extending from the arm 18 of the bar mount. This provide a positive detent between the door and the bar mount, effectively limiting the opening of the door to the amount illustrated in FIG. 1. Obviously, this gap could be varied and would ordinarily be somewhat larger than that shown in FIG. 1 so that mail and papers could be passed back and forth.

When the door is in the position shown in phantom in FIG. 1, the leverage bar will extend out into the interior of the building. The door can be opened no further because of the limiting function of the projection and aperture. If at this point the person on the outside of the door attempts to forcibly intrude, the occupant simply forces the distal end 44 of the bar against the door causing the roller 24 to force the door closed. The end of the bar is then pressed into the latch 46 which also has a horizontal bar support 48, both of which are shown quite well in FIG. 5.

Once the bar is in this position, obviously the door cannot be opened at all. At this point, for additional security, the user may engage any other locks or deadbolts that are on the door. However, the bar is itself stronger than any imaginable door lock available to consumers. It is therefore doubtful that additional security devices would be needed.

Thusfar, operation of the assembly has been described in two modes: first, the limiting mode, in which the door may be opened a limited amount, or "cracked", and second, when the leverage bar is forced against the door and latched in place, forcing the door closed.

Of course, the door must also have an open mode. To open the door once it has been cracked, the door needs to be closed slightly to disengage the projection 42 from the aperture 38, enabling the bar to be swung down into the depending position shown in phantom in FIGS. 2 and 6. The structure is thus totally disabled and the door will operate free of its interference. This is the third mode of operation of the invention.

Whereas the bar will remain in the depending position shown in phantom shown in FIGS. 2 and 6 under the action of gravity without further support, when in the horizontal position, it must be supported so that the projection-aperture limiter will engage properly, and the leverage bar can be swung back and forth in the horizontal plane. The obvious place to achieve this support in the horizontal plane is at the pivotal bar mount 10.

Clearly a number of different ways of achieving this could be used, but a simple and problem-free arrangement involves a retainer pin 50 which passes through openings 52 and 54 in the fixed and rotating plates 14 and 16, respectively. An aligned bore, and perhaps even a metal liner or socket, might be provided inside the frame of the door to insure that the bar is maintained horizontal to tolerances adequate to insure the proper engagement of the limiting function and the bar with the latch 46. The pin should be mounted on a chain 56 or the equivalent, and would require some kind of catch 58 in the form of a spring-loaded ball, to insure that the pin would not accidentally dislodge. A clear alternative would be to make the structure such that the pin would be frictionally engaged in the bar mount structure.

An additional bore 55, spaced from the bore 54 in the plate 16, permits the pin to secure the bar in its depending position if desired. This would keep the bar from being brushed into the door opening unexpectedly. With the two holes 54 and 55, the mounting plate 14 can be rotated and mounted such that the bores 54 and 55 are properly oriented to provide the detents for a door hinged on the opposite side from that shown, and actually even doors hinged on the top or the bottom, for that matter.

Another manner of use of the bar is with outwardly opening doors. In this implementation, the mount would be on the door, and the roller bar would be mounted on the door frame. Some modifications of the structure as shown would be needed for this manner of use.

As an alternative to the roller being mounted on the bar, it could be mounted on the door on a fixed axis, so that the bar would roll against the roller as the door is forced closed. Also, of course the projection and mating aperture 38 and 42 could be reversed, or other detent structure used in place of these two elements. The essence of the invention is the combination of the limited door opening function and the leveraged bar with its ability to force the door closed against any conceivable force.

In any event, the invention provides the next, and perhaps the last, step in physical entry security, and fills the gap in the "prior art" resulting from the provision of door opening limiters with no way of forcibly opening the door once it has opened to its limit.

It is hereby claimed:

1. A leveraged security lock for a door system comprising a door frame having a door mounted in said frame and having a hinged edge and an opening edge, said lock having:

(a) a rigid leverage bar having a pivoted end and a distal end;

(b) a bar mount mounted to said frame and pivotally mounting said bar such that same may be alternatively swung clear of said door in an open mode, or across the opening of said door, to obstruct the opening of said door in a closed mode;

(c) latch means mounted to said door system to latch said bar in said closed mode to prevent the opening of said door; and, (d) said bar having a rolling bearing between the pivoted end and the distal end thereof for bearing against said door, such that the pressure applied to the distal end of said bar forcing same toward the closed mode yields the user a mechanical advantage.

2. A leveraged security lock for a door system comprising a door frame having a door mounted in said frame and having a hinged edge and an opening edge, said lock having:

(a) a rigid leverage bar having a pivoted end and a distal end;

(b) a bar mount mounted to said frame and pivotally mounting said bar such that same may be alternatively swung clear of said door in an open mode, or across the opening of said door, to obstruct the opening of said door in a closed mode;

(c) latch means mounted to said door system to latch said bar in said closed mode to prevent the opening of said door;

(d) said bar having a bearing between the pivoted end and the distal end thereof for bearing against said door, such that the pressure applied to the distal end of said bar forcing same toward the closed mode yields the user a mechanical advantage; and, (e) adjustable mounting means for said roller such that said roller is adjustably mounted on said bar to be adjusted closer to or farther away from said bar to accommodate different door geometry and wear over use.

3. Structure according to claim 2 wherein said roller is mounted to said bar by means of a pivotal swing arm and said adjustable mounting means comprises said swing arm and a variable stop to limit the displacement of said roller away from said door and toward said bar, and including means biasing said roller against said stop.

4. Structure according to claim 3 wherein said stop comprises a threaded stop bolt passing through said bar.

5. A leveraged security lock for a door system comprising a door frame having a door mounted in said frame and having a hinged edge and an opening edge, said lock having:

(a) a rigid leverage bar having a pivoted end and a distal end;

(b) a bar mount mounted to said frame and pivotally mounting said bar such that same may be alternatively swung clear of said door in an open mode, or across the opening of said door, to obstruct the opening of said door in a closed mode;

(c) latch means mounted to said door system to latch said bar in said closed mode to prevent the opening of said door, and including a releasable limiter mounted between said door and said frame to permit said door to be opened only to the limit established by said limiter until same is released, said releasable limiter being part of said bar mount.

6. A leveraged security lock for a door system comprising a door frame having a door mounted in said frame and having a hinged edge and an opening edge, said lock having:

(a) a rigid leverage bar having a pivoted end and a distal end;

(b) a bar mount mounted to said frame and pivotally mounting said bar such that same may be alternatively swung clear of said door in an open mode, or across the opening of said door, to obstruct the opening of said door in a closed mode;

(c) latch means mounted to said door system to latch said bar in said closed mode to prevent the opening of said door, and including a releasable limiter mounted between said door and said frame to permit said door to be opened only to the limit established by said limiter until same is released;

(d) said limiter comprising a projection defined by said bar mount and an opening in said door to receive said projection in detent relationship to prevent the further opening of said door.

7. Structure according to claim 6 wherein said bar mount includes an arm extending out away from said frame and across toward said door, and pivotally mounts said bar on the extended end thereof.

8. Structure according to claim 7 wherein said mount is swivel-mounted to said frame such that said arm and bar will swing down into a vertical position alongside said door and clear of same.

9. Structure according to claim 8 and including detent means for selectively supporting said bar in a horizontally pivotal orientation in which the bar can swing between the open and closed modes in the horizontal plane and be released to depend vertically from the bar mount down alongside the door to permit unimpeded operation of said door.

10. Structure according to claim 1 wherein said bar mount can be rotated and mounted at an orientation to permit the leveraged security lock to be mounted on either a left-side hinged door or a right-side hinged door.

* * * * *